US005348257A

United States Patent [19]

Ocampo

[11] Patent Number: 5,348,257

[45] Date of Patent: Sep. 20, 1994

[54] RAILROAD SWITCH HEATING CONTROL

[76] Inventor: Salvador C. Ocampo, 4715 W. Wrightwood Ave., Chicago, Ill. 60639

[21] Appl. No.: 27,357

[22] Filed: Mar. 8, 1993

Related U.S. Application Data

[63] Continuation-in-part of Ser. No. 889,061, May 26, 1992, Pat. No. 5,192,038, which is a continuation-in-part of Ser. No. 776,725, Oct. 15, 1991, Pat. No. 5,116,006, which is a continuation of Ser. No. 405,659, Sep. 11, 1989, abandoned.

[51] Int. Cl.[5] ..... E01B 7/24

[52] U.S. Cl. ..... 246/220; 246/428

[58] Field of Search ..... 200/239, 249, 251, 286, 200/341; 246/162, 176, 220, 428, 444, 473.1, 473.3

[56] References Cited

U.S. PATENT DOCUMENTS

| | | | |
|---|---|---|---|
| 500,041 | 6/1893 | Swartz | 246/220 |
| 763,420 | 6/1904 | Owen | 246/220 X |
| 975,922 | 11/1910 | Adams | 246/220 X |
| 1,038,450 | 9/1912 | Showalter | 246/220 |
| 1,781,284 | 11/1930 | Karl | 246/176 |
| 2,644,657 | 7/1953 | White, Jr. | 246/428 |
| 2,740,041 | 3/1956 | Marcum | 246/220 |
| 3,264,472 | 8/1966 | Simmons | 246/428 |
| 4,051,466 | 9/1977 | Protze | 246/428 X |
| 4,108,405 | 8/1978 | Gibson | 246/473.1 X |
| 4,195,805 | 4/1980 | Keep, Jr. | 246/428 |
| 4,391,425 | 7/1983 | Keep, Jr. | 246/428 |
| 4,687,163 | 8/1987 | Ringer | 246/428 |
| 4,986,498 | 1/1991 | Rotter et al. | 246/220 X |
| 5,004,190 | 4/1991 | Montierth et al. | 246/428 |

FOREIGN PATENT DOCUMENTS

| | | | |
|---|---|---|---|
| 588971 | 12/1959 | Canada | 246/428 |
| 598866 | 12/1925 | France | 246/162 |
| 629299 | 11/1927 | France | 246/220 |
| 761457 | 3/1934 | France | 246/220 |
| 52348 | 4/1910 | Switzerland | 246/162 |
| 898091 | 6/1962 | United Kingdom | 246/428 |

*Primary Examiner*—Michael S. Huppert
*Assistant Examiner*—Scott L. Lowe
*Attorney, Agent, or Firm*—Martin Faier

[57] ABSTRACT

A control and detector for a railroad switch point having a detector mechanism which is secured to a stockrail at the switch point where the stockrail is intended to be in contact with a corresponding switchrail. The detector mechanism is secured in a housing and has a plunger assembly biased in the direction of the switchrail and reciprocably secured preferably in alignment with the switchrail at the switch point. Electrical contacts connected to the plunger assembly report contact or a lack of contact between the switchrail and the stockrail. A contact on the switchrail at the switchpoint for reciprocates the plunger against the electrical reporting contacts when the switchrail is in physical contact with the stockrail at the switchpoint. A heating element is associated with the switchpoint and us energized in response to contact between the stockrail and switchrail as detected by the detector mechanism.

30 Claims, 4 Drawing Sheets

RAILROAD SWITCH HEATING CONTROL

This application is a continuation in part of my copending application Ser. No. 07/889,061, for a SAFETY DETECTOR FOR RAILROAD SWITCH POINTS WITH VISUAL INDICATOR MECHANISM, filed May 26, 1992, now U.S. Pat. No. 5,192,038, granted Mar. 9, 1993, which was a continuation in part of my application Ser. No. 07/776,725, for a SAFETY DETECTOR FOR RAILROAD SWITCH POINTS WITH REMOTE CONTACT MECHANISM, filed Oct. 15, 1991, now U.S. Pat. No. 5,116,006, granted May 26, 1992, which was a continuation of my application Ser. No. 07/405,659, for a SAFETY DETECTOR FOR RAILROAD SWITCH POINTS, filed Sep. 11, 1989, and now abandoned.

This invention relates to a railroad switch heating control, and is more particularly directed to such a device which is capable of positively turning a heating element for a railroad switch point on or off depending upon whether heat is required at the switch point responsive to whether the switchtrack is properly aligned with the stockrail. With the device embodying the present invention, associated with the safety detectors disclosed in my U.S. Pat. Nos. 5,192,038 and 5,116,006, it is not possible to detect when the switchrail and stockrail are not positively aligned, but it is also possible to control a heating element for the switchpoint responding to conditions requiring more or less heat, assuring that energy for heating the element is not wasted.

By incorporating a heating control embodying the present invention into a railroad switch heating system, operating costs for a typical switch heating system can be substantially reduced Not only can such a system utilizing the present invention increase efficiency, but opportunities for increased safety and versatility of the system not presently available become possible.

BACKGROUND OF THE INVENTION

Devices for ascertaining whether a railroad switch is open have been used in association with switch mechanisms for many years in railroad yards, hump yards and on mainlines; however such devices have not been used to control heating at a switchpoint.

Heat at the switchpoint is required to prevent freezing and accumulation of snow and ice preventing the switch from moving when desired. Where a switch is frozen, or snow or ice interferes with the opening or closing of the switch, there is great danger of derailment, causing substantial loss of persons or property.

Many means have been used to keep a switchpoint free of ice and snow. For many years, trackmen have been known to set fires at the switchpoint during storms to prevent snow and ice buildup which if allowed to accumulate may prevent movement of the switch, but also may cause a false reading showing the switchpoint to be closed when it is really open. Gas heaters are also available with heating nozzles for applying heat at the switchpoints. The more modern means to prevent snow and ice build-up is to install a heating element or Calrod on the stockrail at the switchpoint. During a storm, these heating element are turned on and left on until the danger of snow or ice build-up is over, even when the switch is fully closed as intended and heat is not required. When sophisticated equipment is available for detecting whether a switchpoint is open or closed and there is high energy equipment for applying heat to the switchpoint during a storm, and the control may be in a tower remote from the switch, and a whole maze of detectors and controls is in a train make-up yard where there may be many switchpoints, the system becomes rather complicated and the possibility of human error increases with very high stakes.

However, even with such sophisticated equipment, railroads suffer derailments. Many derailments can be traced to conventional mechanisms for detecting whether a switch is open or closed. Such prior art mechanisms are usually of a type which detect an obstructed open switch point, but only if the obstruction results in mechanical pressure directed against the switch machine. If there is no obstruction, the detector mechanism may cause an erroneous reading. Likewise, conventional wisdom is to apply heat to the entire switchpoint, irrespective of localized needs, thus wasting energy and losing efficiency.

Many switches in the railway industry are manually operated, usually because the switch is remote from a source of adequate electricity or track use doesn't justify the cost of installing electric switches. That factor also reflects conventional thinking about the availability of power to heat the switchpoint, where conventional heating elements are about 16 ft. long and normally consume about 480 volts of electricity.

Such manually operated switches are usually located in areas where trains loaded with hazardous materials and chemicals and other critical cargos travel. Frequently, derailments at such locations are caused by open switchpoints, usually because of human error or failure to notice that the switchpoint is safely closed against the stockrail during operations in bad weather or without visibility. Also, such manually operated switches are usually in locations where switch service is not so effective, making it easier to miss mistakes in calibrations or settings leading to a false belief that a switchpoint is closed when in fact it is open. The use of an electric switch or heater in these circumstances could prove valuable if energy requirement were not burdensome.

Sometimes stop signs and similar devices are mechanically attached to manually operated switch gear boxes, which are designed only to indicate which route the switch is directed to and not to whether the switchpoint is open or closed. False reliance on these devices, coupled with a switchman's conception of the switch condition, usually under pressure to throw another switch keeping the train moving, leads the switchman to assume the switchpoint is in the position designated because the switch lever has dropped inside the lever slot, without inspection of the switchpoint.

Even with powered switches in hump or switch yards with sophisticated equipment derailments are not infrequent and are often disastrous when they occur. Investigation sometimes reveals an obstruction at the switchpoint, or misadjustment or worn out movable parts and mechanical components, sometimes just a light bulb. Such failures may be traced to loose or worn out movable parts and mechanical components, poor maintenance, loose ballast conditions, loose stockrail braces, worn out or loose throwrod adjusting nuts, baskets, or broken throwrods, worn out or broken lugs connecting the switch sectors and throwrods, or just the inability to have adequate heat at the right location to keep the switchpoint free of ice, slush and snow.

Sometime derailment is caused by human error because the sun light was too bright to see the safety light in the field or a obstructed switchpoint. In these situations the "clear" safety signal indication, either in the tower or on the field, may be false and can be the direct cause of derailment. Operating personnel sometimes can't see a faulty switchpoint in time to take action avoiding a derailment, because a light is burned out or there is glare, or darkened conditions or obstructions.

Failure can be traced to prior art detectors, adjusted and set according to calibrations, rather than a positive relationship between the stockrail and the switchrail at the point where they are intended to come together or be separated. Even if a conventional detector is initially properly calibrated, changes occur which make the calibration inaccurate or obscure the detector. If the calibration is changed by conditions which are not regularly ascertained and checked, sometimes by a misalignment of merely 0.05 inch, such as movement of the tracks, detector or switch components relative to one another, which may result from vibrations of a locomotive or rolling stock over the track or a change in weather, a derailment may result. Power may also be interrupted or a warning source obliterated or inoperative—any of which can cause a derailment. Any of these conditions, including insufficient heat at the switchpoint may cause conditions which could be better dealt with by the present invention.

SUMMARY OF THE INVENTION

The present invention provides suitable heat at the switchpoint and may also detect movements at the switchpoint for safety purposes. This invention is characterized by control mechanism securely mounted to the stockrail which positively "feels" the switchtrack in a selected position at the point so that it positively notes whether the point is open or closed. The condition of the switchpoint may be made known through a signal system, and the system may also control application of heat to the switchpoint when called for.

The heat source at the switchpoint is controlled by the detector. The signal and safety systems described in this application and in the parent applications may be incorporated into the heating control system. The control may be set to deliver heat only to an open switchpoint or responsive to weather conditions more heat may be delivered or applied at other locations, making the system cost effective and efficient.

The system may include a visual indicator mechanism to warn operating personnel of the condition of the switchpoint, and may include magnifying devices which can be focused to a specific point. These indicators may utilize easily detectable six, robe lights, and may be magnified, too, as to make them easier to read without drawing excessive power. Visual, adjustable powered indicators can be provided to focus on moving trains so that operating personnel can readily notice a faulty switchpoint. The mechanism embodying the invention provides accurate detection of changes in throwrod adjustments causing the point to open, including failures due to wearing of movable parts, misalignments, adverse weather conditions, and breakdown of mechanical components. With the visual indicator mechanism reliable means are provided for sighting an open switchpoint.

In this invention, the heat control and detector system may be connected to the stockrail as shown in the cited parent applications and is encased in heavy duty mechanism adequate to hold its adjustment, thus protecting the system from misalignment due to vibrations and adverse weather conditions. The mechanism may be fabricated so that it is not readily available to yard personnel or others who may in error vary its calibration.

The present invention also includes a novel adjustable tensioned clamp arrangement for securing the control and detector to the stockrail.

OBJECTS AND ADVANTAGES OF THE INVENTION

The object and advantage of this invention is to provide a novel heating control and detector for a railroad switchpoint.

Another object is to provide such a heating control and safety detector which is positively indicates whether or not a switchpoint of a railroad is open or closed.

Another object is to provide such a control and detector which is firmly secured to a stockrail located at the switchpoint.

Another object is to provide such a novel control and detector which may extend beneath the stockrail at the switchpoint.

Another object is to provide novel adjustable heavy duty spring loaded means in a control and detector mechanism for a switchpoint, suitable for holding its adjustment.

Another object is to provide a heavy duty control and detector mechanism which may be sealed in an adjusted condition but available for use and adjustment by trained personnel.

Another object is to provide control and detector mechanism for a switchpoint which includes visual indicators showing a switchpoint open or closed, which can be adjusted and focused to alert operator personnel.

Another object is to provide a heavy duty switch housing for such a control and detector system which is remote from the rail and fully protected against unintended misadjustment.

Another object is to provide means for securely adjustably mounting such a control and detector mechanism at the switchpoint.

Another object is to provide a control and safety detector which is easy to manufacture, install and use, and which is efficient and reliable in operation.

These and other objects and advantages of the invention will become more apparent as this description proceeds, taken in conjunction with the accompanying drawings.

DESCRIPTION OF PREFERRED EMBODIMENTS

Figure 1:
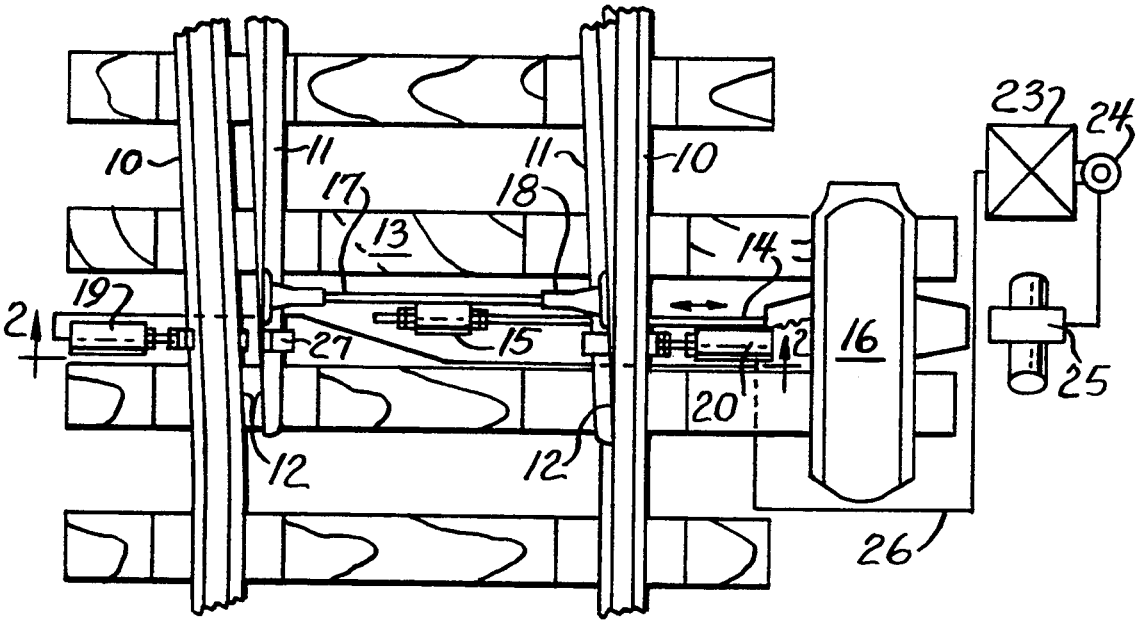
FIG. 1 is a top elevational view of points of a switchtrack and stockrail with switch members, parts being broken away, showing a novel control and detector embodying the invention.

With reference to the accompanying drawings, in which like numerals represent like structural members, a switchpoint where spaced apart stockrails or tracks 10 meet spaced apart switchrails 11 is designated as the point 12, and identifies the location where the stockrail or tracks 10 and switch rail 11 must be brought together or closed, or spaced apart or opened, to allow a train to pass thereover without fear of derailment. If the tracks are separated more than about 0.05 of an inch, a derailment may result.

These tracks are mounted laterally on a series of spaced apart ties 13. Conventionally, the opening and closing of the switchtrack 11 against the stockrail 10 at the point 12 is controlled by a switching device, which includes a switch throwrod 14 connected at one end to a switch basket 15 and at its other end spaced apart from the tracks to a switching machine 16, and the basket 15 is connected to the switchrails 11 through a bolt and plate assembly to switch bars 17, the bars being connected to each of the corresponding aligned switchrails 11 by means of bracket assemblies 18, one on each switchrail.

At the point 12, arranged between the ties 13, along the corresponding aligned stockrails 10, there is secured to each of said stockrails, a control and detector device 19 embodying the present invention. This device 19 comprises a housing 20, which contains switch members hereafter described. This housing 20 may be secured to the heel 21 of the stockrail 10 by means of clamp bracket 22.

The clamp 22 is formed with an open ended jaw 34 and a hooked jaw 35, so that it slips over the edges of the stockrail heel 21 and has an adjustment bolt 23 which can be moved toward or away from the central area of rail 25, and may include an offset **22*a* for a purpose to be hereafter discussed. The clamp 22 is attached to a tubular member 28, having a cap 31 arranged on threaded portion 32 of a tube 30**.

Figure 2:
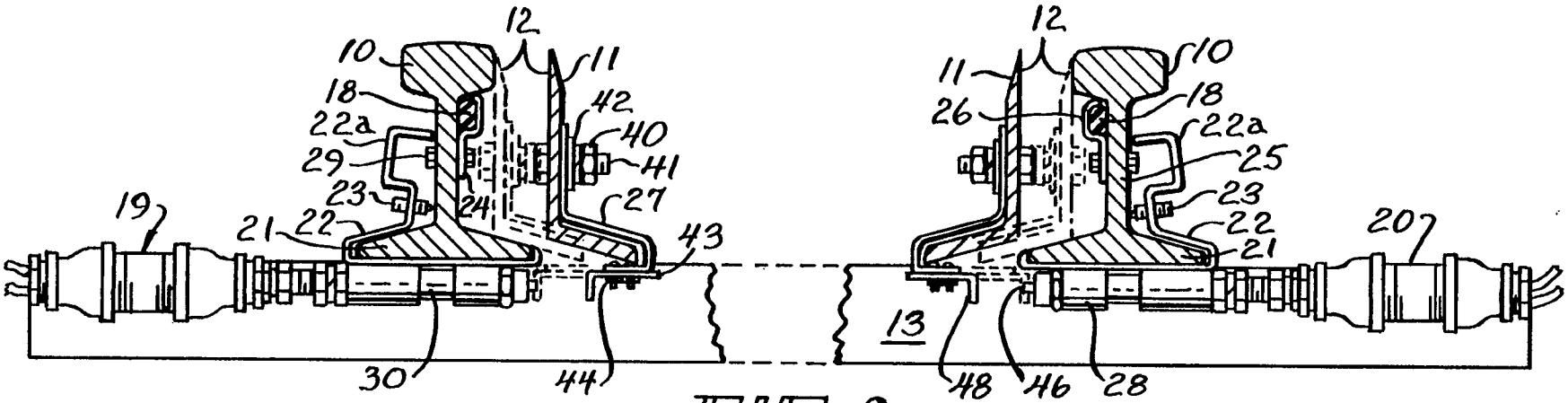
FIG. 2 is an side elevational view, partially in section, of the FIG. 1 structure omitting the switching members, taken on line 2—2 of FIG. 1.

Attached to the central area 25 of the stockrail 10 is tubular heating element 18, secured by a heater bracket 24 having an offset flange 26, which may be mounted to the stockrail by means of a nut and bolt assembly 29. This heating element 18 is preferably in intimate contact with the stockrail 10 just below its crown so that its will provide heat to the switchpoint 12 without interfering with the opening and closing the the switchrail 11 against the stockrail 12. As shown in FIG. 2, the stockrail heel clamp bracket 22 has an offset **22*a* which may accommodate the heating element securement nut and bolt 29. Such heating elements may be installed along about a 16 ft. length where the switchtrack and stockrail are adjacent to one another, and they may also be installed on either or both sides of the stockrail. Sometimes, a gas fired heater (not shown) may be used at the switchpoint, in which case, a standard electrically operated solenoid may be used to open and shut the gas line instead of applying heat the the heating element, still operated by the control and detector embodying the present invention. This heating element 18** is wired into the control circuit in a manner hereinafter described.

Securely attached to the switchrail 11 is an adjustable bracket 27, which may be secured in place by nuts 40, bolts 41 and washers 42, on loosening the nuts 40, to a selected position and then tightening the nuts. At the remote end of and connected to this bracket 27 is an arm 43, which may be attached to the bracket by means of bolts 44, and the position of the arm 43 relative to the bracket 27 may be adjusted by sliding the arm 43 in a slot (not shown) oriented in the direction of the opening and closing of the switchtrack 11 against the stockrail 10. The end of the arm 43 carries a finger 48, and its adjustment may be varied as described.

This finger 48 is adapted to contact the tip 46 of the shaft 47 which and extends through the pipe body or tube 30. The shaft tip 46 extends through a central opening in cap 31. The shaft 47 is joined to plunger 36 and both are loaded in the direction of the tip 46 by spring 38. The pipe body 30 extends into the housing 20 and may be adjustably secured thereto in a selected position by means of threaded assembly 37.

The housing 20 is torpedo shaped and may have a threaded end 49, through which the plunger 36 extends, and threaded end 50, having a plug 51, through which wires 52 exit the housing 20. Carried on the plate 54 in the housing 20 are pairs of switch contacts 55 and 56, which may be anchored to the plate, and which may be connected to the wires 52, and this plate 54 may be anchored in the housing by screws 57 connected to an exit coupling 58 attached to the housing 20 through which the wires 52 exit. Secured to the end of the plunger 36 is a male contact 60 which may enter between the contacts 55 and 56. When the plunger 36 is reciprocated against the contacts 55 and 56 upon movement of the tip 46 and shaft 47 the circuit is closed to activate the control and detector in a manner to be described.

Figure 3:
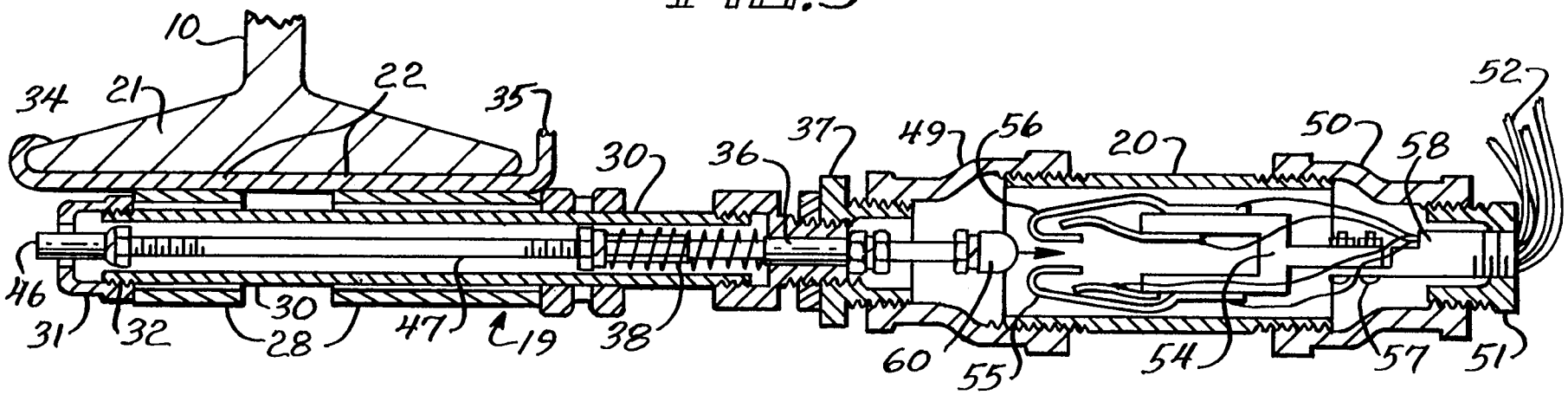
FIG. 3 is a view of the unique contact arrangement for the control and detector embodying the present invention.

As shown in FIGS. 2–3, the switchrail clamp bracket 27, plunger 36, shaft 47, arm 43 and finger 48 and the connecting means for the same are fully adjustable, and the adjustments may be locked into position, so that the contacts may be placed in fixed relation to one another, when adjusted, to always cause the male contact 60 to enter between the contacts 55 and 56, thus opening or closing the circuit, upon reciprocation of the switchrail 11 against the stockrail 10 when the shaft tip 46 is depressed to close the circuit as described. If the point 12 is not completely closed, the tip 46 is biased away from the contacts 55 and 56, and the circuit will not close. If the point 12 is completely closed, the tip 46 will cause the male contact 60 to be thrust against the contacts 55 and 56, causing the circuit to close.

Figure 4:
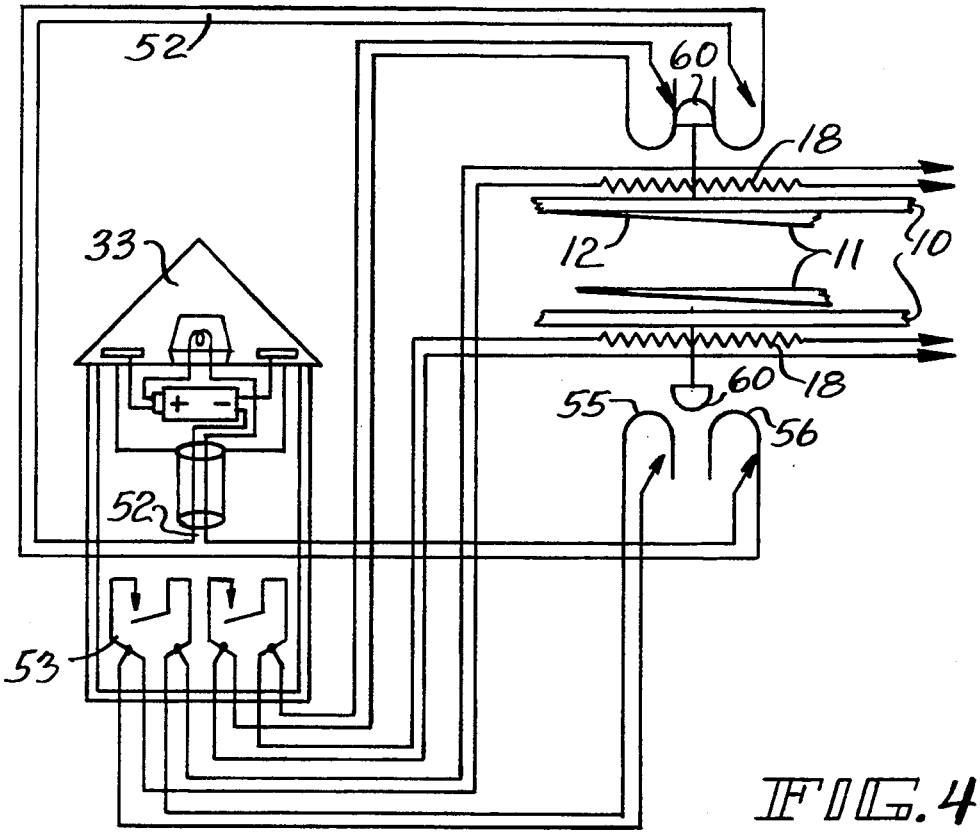
FIG. 4 is a schematic view of the electrical members embodying the present invention, showing the pair of contacts, one in open position and the other in closed position, which includes a by-pass switch arrangement.
Figure 5:
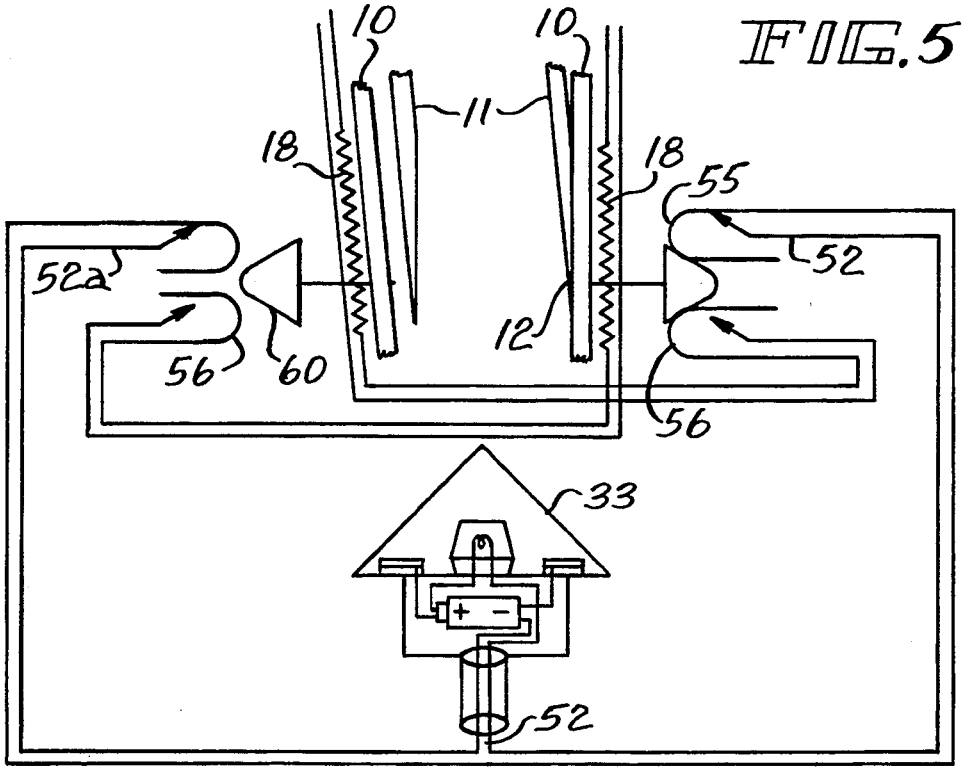
FIG. 5 is another schematic view of electrical members embodying the present invention, showing a modified electrical arrangements, with a pair of contacts, one in open position and the other in closed position, without the by-pass switch arrangement.
Figure 6:
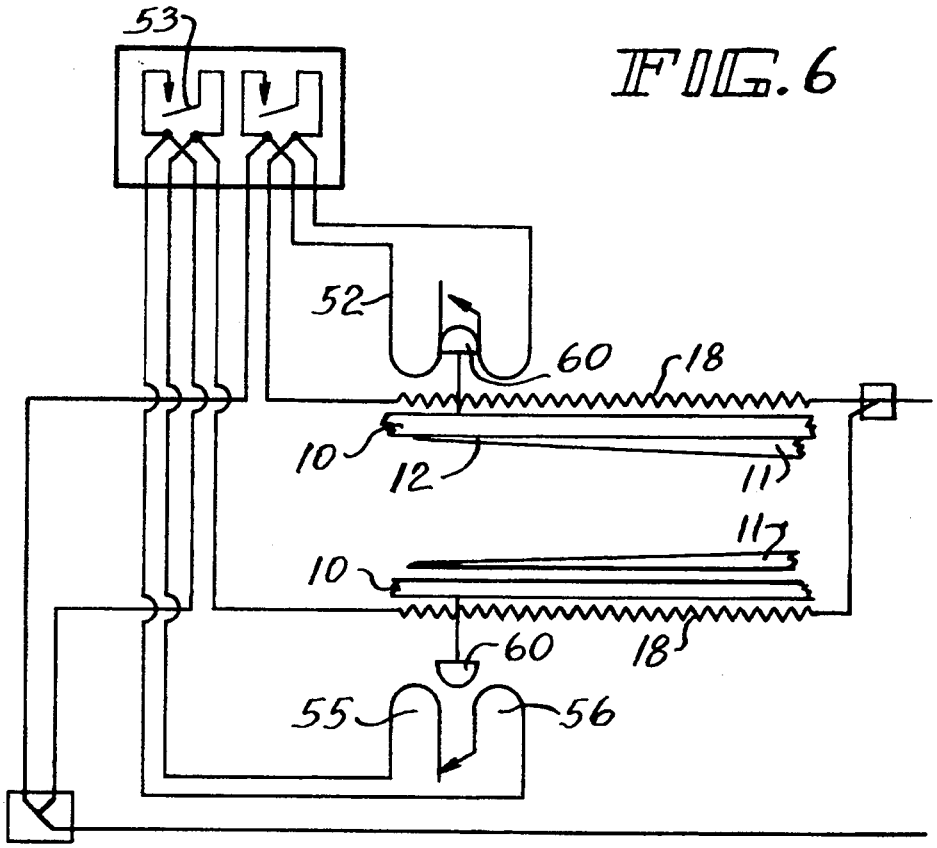
FIG. 6 is a schematic of another electrical circuit arrangement similar to the FIG. 5 arrangement, except depicting only the heating control and by-pass switch circuit.
Figure 7:
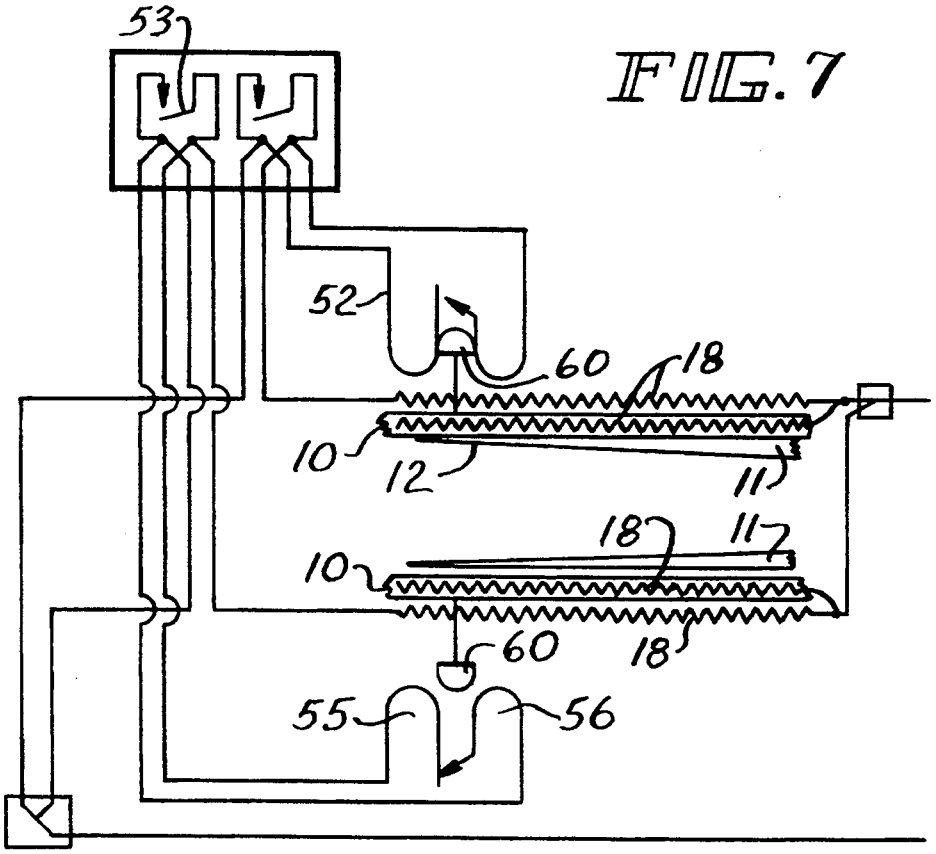
FIG. 7 is a schematic of another electrical circuit arrangement similar to the FIG. 6 arrangement, except depicting electrical heating applied to both sides of the stockrail.

With this heating element 18 in the circuit, as shown in FIGS. 4–7, the heating element may be selectively energized to deliver heat to the switchpoint when the tip 46 of the plunger 36 contacts the finger 48 to positively indicate that the switchpoint 12 is closed. As shown in FIGS. 4, 6 and 7 a by-pass switches 53 may be included in the circuit, which will permit the operator to selectively control the heating elements 18 irrespective of whether the switchpoint 12 is open or closed, for example, in storm conditions where extra heat is required at the switchpoint. The control mechanism may be used strictly to selectively deliver heat to the heating elements 18 of a closed switchpoint, as shown in FIG. 6, which may be varied by throwing the by-pass switches; or the heat may be increased substantially by having more than one set of heating elements 18 associated with each switchtrack and stockrail, one set of heating elements on each side of each stockrail 10. The control and detector should be connected to a power source as shown by arrows in FIGS. 4, 6 and 7.

When the male contact 60 is closed against the contacts 55 and 56, a circuit is made through the wires 52, which may switch on an appropriate light 33 in the signal means, such in the yard or tower or other indicia to report the point 12 is closed. On the other hand, if the male contact 60 is not closed against the contacts 55 and 56, the circuit is not made and may cause another signal to report that point is open. The circuit may be integrated with the line electrical system, located at the switch in the yard and/or they may be remote from the switchtrack in a control house for the switch yard or other railroad system.

The invention may also include the visual indicator 33, which may be a strobe light, and which may be flashing, focusable and include magnification, may be connected in the electrical circuit by electric wires 52 to the control and detector device 19.

The control and detector device embodying the present invention may be secured through the stockrail or arranged beneath the tracks and within dimensions extending downwardly parallel to the tracks so that the control and detector mechanism will not interfere with operation of a train traveling thereover. Also the detector mechanism is fully horizontally adjustable, and the detector will be actuated to show the point 12 is actually closed only when the switchtrack 11 is physically manipulated home against the stockrail 10. The detector mechanism disclosed herein may be incorporated into other railroad switchyard, mainline and hump yard systems for the purpose of indicating whether or not the point 12 is in fact open or closed.

The location for installing the control and detector embodying the present invention may be at or near the switchpoint, as shown. In some cases the throw of the reciprocating plunger away from the stockrail will have to be lengthened in order to have firm contact with the switchrail, as the space at the point between the stockrail and the switchrail is sometimes tapered from the end of the switchtrack.

It is believed that through the use of the present invention, there can be a substantial savings in energy costs with greater efficiency. For example, in one yard alone, it has been estimated that each electric heating element, applying continuous heat as long as the heater switch in on, to a single switchpoint, running at 480 V. AC, irrespective of whether the switchpoint is open or closed (when heat is no longer required) costs about $1,000 per month in energy expense, and in that yard there exists about 70 switches, each having two sets of heating elements.

While preferred embodiments of the novel control and detector mechanism has been shown and described in considerable details, it is not intended that the invention should be limited to the exact construction described, as many variations and changes can made in details of the structure without departing from the spirit of the invention. Accordingly, the invention should not be limited to the structure described except as the same may be defined by the appended claims.

I claim:

1. A control and detector apparatus for a railroad switch point where a switch rail is intended to contact a stock rail in a given plane, said apparatus comprising a detector mechanism secured to said stock rail at said point, said detector mechanism having a spring loaded plunger assembly normally biased in transverse the direction of said switch rail reciprocally secured in alignment with said switch rail at said point and electrical contact means associated with said plunger assembly for reporting contact or the lack of contact between said switch rail and said stock rail, adjustable means mounted on said switch rail at said point adapted to contact and reciprocate said plunger assembly, causing said electrical contact means to report when said switchrail is in physical contact with said stockrail at said point, said detector mechanism having a housing located adjacent said stockrail for containing said electrical contact means and plunger assembly, said housing comprising a closed body secured to said stockrail, said plunger assembly having a contact end extending from said housing adjacent said stockrail and a remote end a rigid connection extending between and affixed to said contact end and said remote end, said electrical contact means comprising electrical contact members secured in said housing and a male contact element on said remote end for contacting said electrical contact members when said plunger is reciprocated, and heating means associated with said switchpoint and adapted to disseminate heat in response to contact between said rails as detected by said detector mechanism.

2. The control and detector apparatus recited in claim 1, wherein said spring loaded plunger assembly's contact end extending from said housing, extends beneath and in transverse alignment with said stock rail and in the direction of said switch rail.

3. The control and detector apparatus recited in claim 1, wherein said plunger assembly comprises a movable shaft extending through a fixed pipe body and has a spring biased against said body urging the shaft in the direction of the switch rail.

4. The control and detector apparatus recited in claim 3, wherein said movable shaft is adjustably secured in said pipe body.

5. The control and detector apparatus recited in claim 1, wherein said stock rail and said switch rail each have a heel, and said plunger assembly is secured to said stock rail at a level below said heel.

6. The control and detector apparatus recited in claim 1, wherein said stock rail has a heel, and said detector mechanism is secured to said heel by an adjustable clamp mechanism secured thereto.

7. The control and detector apparatus recited in claim 1, wherein said housing has a cover for removable secured closing of said hounding.

8. The control and detector apparatus recited in claim 1, wherein said electrical contact members comprise a set of aligned contacts which make or break a circuit when said male contact element is reciprocated against said aligned contacts.

9. The control and detector apparatus recited in claim 8, wherein said male contact element is adjustable on the plunger assembly for selectively adjusting the spacing between said aligned contacts and said male contact element.

10. The control and detector apparatus recited in claim 1, wherein said adjustable means comprises a bracket adjustably secured on said switch rail.

11. The control and detector apparatus recited in claim 10, wherein said bracket has an arm extending from said switch rail adapted to contact said plunger assembly when said switchrail is in contact with said stock rail.

12. The control and detector apparatus recited in claim 11, wherein said arm has a finger which is bent toward said stockrail a distance sufficient to permit said switch rail to close against said stockrail before said finger fully reciprocates said plunger assembly.

13. A control and detector apparatus for a rail road switch point where a switch rail is intended to contact a stock rail in a given plane, said apparatus comprising a detector mechanism secured to said stock rail at said point, said detector mechanism having a plunger assembly biased in the direction of said switch rail reciprocally secured in transverse horizontal alignment with said switch rail at said point and electrical contact means associated said plunger assembly for reporting contact or the lack of contact between said switchrail and said stockrail, adjustable means on said switch rail at said point for reciprocating said plunger assembly, causing said electrical contact means to report when said switchrail is in physical contact with said stockrail at said point, said detector mechanism having a closed housing containing said electrical contact means, said plunger assembly having a contact end adjacent said stock rail and a remote end, said electrical contact means comprising electrical contact members secured in said housing and a male contact element on said remote end for contacting said electrical contact members when said plunger assembly is reciprocated, and heating means associated with said switchpoint and adapted to disseminate heat in response to contact between said rails as detected by said detector mechanism.

14. The control and detector apparatus recited in claim 13, wherein said contact end is reciprocated in a pipe body and only a tip of said contact end of said plunger assembly adapted to contact said switch rail is exposed and extends from said pipe body.

15. The control and detector apparatus recited in claim 14, wherein said plunger assembly is adjustable relative to said electrical contact members.

16. The control and detector apparatus recited in claim 14, wherein said electric contact members are connected to a visual indicator device which is actuated when said male contact element is reciprocated against said electrical contact members.

17. The control and detector apparatus recited in claim 13, wherein said heating means comprises a tubular heater mounted on said stockrail.

18. The control and detector apparatus recited in claim 13, wherein said heating means has a by-pass switch assembly selectively permitting energizing of said heating means independently of contact between said rails.

19. The control and detector apparatus recited in claim 13, wherein said heating means is in intimate contact with one of said rails.

20. The control and detector apparatus recited in claim 19, where said heating means is in contact with opposed surfaces of one of said rails.

21. The control and detector apparatus recited in claim 19, where said heating means is secured to said one by a bracket and connector assembly secured to said one.

22. A control and detector apparatus for a railroad switch point where rails consisting of a switch rail and a stock rail are intended to contact one another in a given plane, said apparatus comprising:

a detector mechanism adjustably secured to one of said rails at said point, said detector mechanism having a connecting assembly directed toward said other rail to report whether there is substantial contact between said rails at said point, a housing secured on said one rail to which said detector mechanism is secured, electrical contact means in said housing adapted to receive the report of said detector mechanism, said connecting assembly connecting said detector mechanism and said contact means, said connecting assembly having a contact end adjacent said detector mechanism and a remote end, said electrical contact means comprising electrical contact members secured in said housing and a male contact element on said remote end for actuating said electrical contact members when said connecting assembly reparts, and heating means associated with said switch point and adapted to disseminate heat in response to contact between said rails as detected by said detector mechanism.

23. The control and detector apparatus recited in claim 22, wherein said rails have a heel and a clamping member is secured on the heel of said one rail to which said detector mechanism is secured and said housing is secured to said clamping member.

24. The control and detector apparatus recited in claim 23, wherein said clamping member is adjustable relative to said housing.

25. The control and detector apparatus recited in claim 23, wherein said clamping member has adjusting means for holding the clamping member on the one rail's heel under tension.

26. The control and detector apparatus recited in claim 22, wherein said heating means comprises an electrical heating mechanism connected to said stock rail.

27. The control and detector apparatus recited in claim 22, wherein said detector mechanism, connecting assembly and electrical contact means are arranged aligned with, but beneath, the plane of said rails.

28. A control and detector apparatus for a railroad switch point where a switch rail is intended to contact a stock rail in a given plane, for ascertaining whether or not said switch point is open or closed and selectively delivering heat to said switchpoint, said control and detector apparatus comprising a detector mechanism secured to said stock rail at said point, said detector mechanism having a plunger assembly biased in the direction of said switch rail reciprocally secured in transverse alignment with said switch rail at said point, electrical contact means associated with said plunger assembly for reporting contact or the lack of contact between said switchrail and said stockrail, and adjustable means on said switch rail at said point for reciprocating said plunger assembly, causing said electrical contact means to report when said switchrail is in physical contact with said stockrail at said point, said detector mechanism having a housing attached to said stock rail containing said electrical contact means and plunger assembly, said plunger assembly having a contact end adjacent said stock rail and a remote end, said electrical contact means comprising electrical contact members secured in said housing and a male contact element on said remote end for contacting said electrical contact members when said plunger assembly is reciprocated, and an electrical circuit associated with said electrical contact members, for controlling the delivery of electrical current to a control means wired in said electrical circuit, said control means being capable of selectively delivering heat to said switch point.

29. The control and detector apparatus recited in claim 28 wherein said plunger assembly is adjustably secured in a pipe body.

30. The control and detector apparatus recited in claim 28 wherein said adjustable means comprises a bracket adjustably secured on said switch rail.

* * * * *